United States Patent [19]

Zapf

[11] 3,951,453

[45] Apr. 20, 1976

[54] SEATING DEVICE HAVING A WEIGHTED CUSHION

[75] Inventor: Otto Zapf, Eschborn, Germany

[73] Assignee: Knoll International, Inc., New York, N.Y.

[22] Filed: Dec. 5, 1974

[21] Appl. No.: 529,964

[30] Foreign Application Priority Data

Mar. 23, 1974 Germany ..... 7410172[U]

[52] U.S. Cl. ..... 297/440; 297/397; 297/414

[51] Int. Cl.[2] ..... A47C 7/00

[58] Field of Search ..... 5/341, 344; 248/346, 248/506, 500; 297/391, 397, 414, 440, DIG. 6

[56] References Cited

UNITED STATES PATENTS

| | | | |
|---|---|---|---|
| 2,976,914 | 3/1961 | Miller | 297/DIG. 6 |
| 3,139,632 | 7/1964 | Johns | 5/341 |
| 3,148,389 | 9/1964 | Lustig | 5/341 X |
| 3,226,737 | 1/1966 | Rote | 5/344 |
| 3,603,639 | 9/1971 | Wilson | 297/DIG. 6 |

FOREIGN PATENTS OR APPLICATIONS

| | | | |
|---|---|---|---|
| 1,529,539 | 1/1971 | Germany | 297/397 |

*Primary Examiner*—James C. Mitchell
*Attorney, Agent, or Firm*—Cooper, Dunham, Clark, Griffin & Moran

[57] ABSTRACT

A seating device includes a base portion and at least one top cushion movably positioned on the base portion. An insert of relatively heavier material than that of the cushion is placed in the lower portion of the cushion to maintain the latter in a selected position on the base while the seating device is in use. The top cushion may be an arm cushion, a back cushion or a head cushion, and is made from foam, cotton-wool or the like. The insert in the lower portion of the top cushion may be of a loose, pourable granulate material such as sand, and this material may be contained in a partitioned cover to maintain the material in a desired distribution. Additional holding power for maintaining the top cushion in a selected position can be obtained by affixing a VELCRO fastener to the underside of the top cushion.

7 Claims, 9 Drawing Figures

Fig. 1.
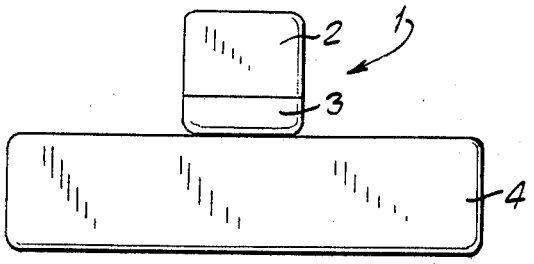
Fig. 2.
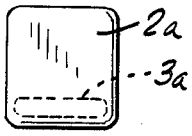
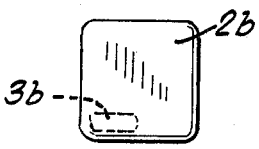
Fig. 3.
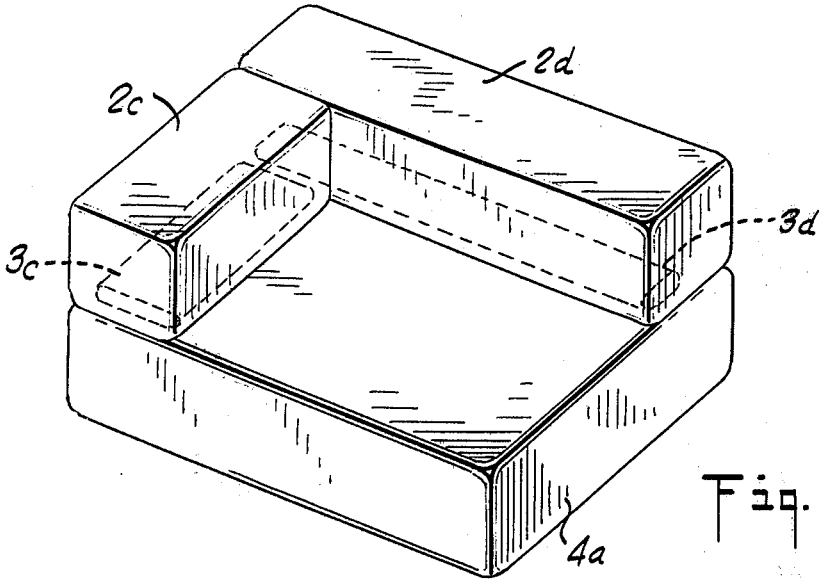
Fig. 4.
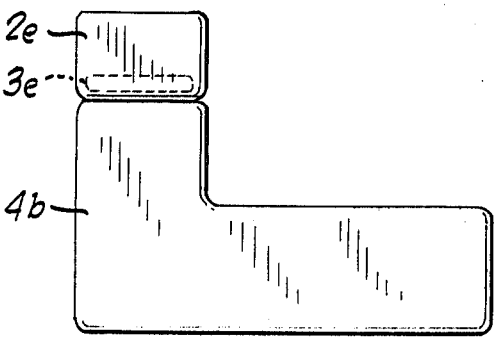
Fig. 5.

Fig. 6.
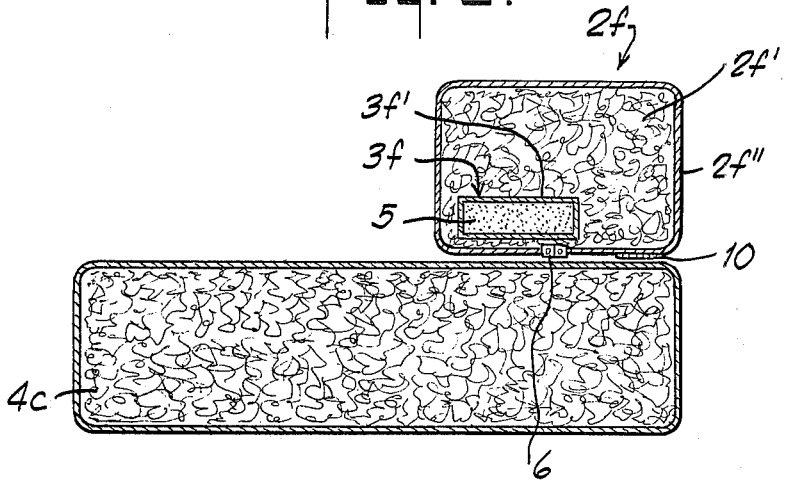
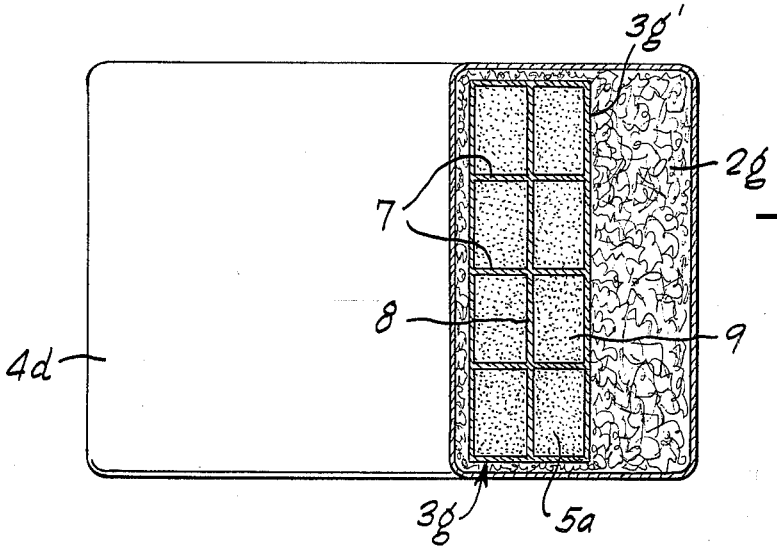
Fig. 7.
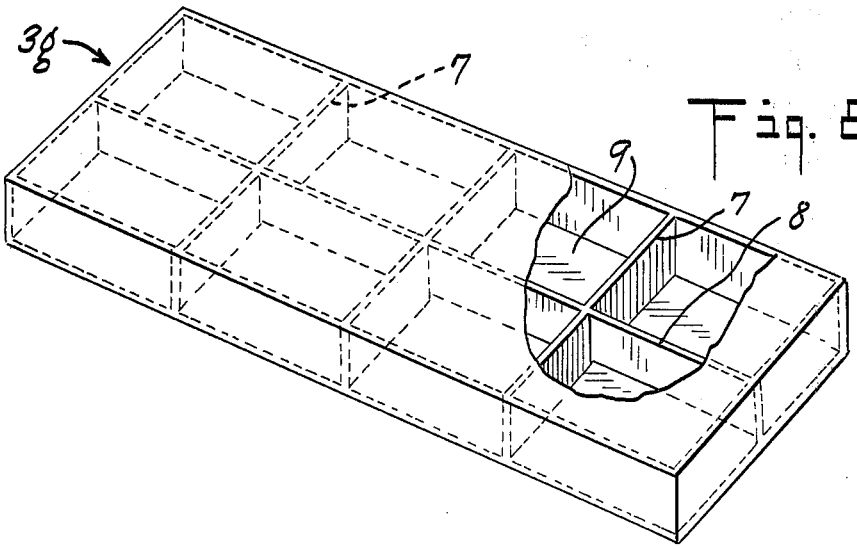
Fig. 8.

SEATING DEVICE HAVING A WEIGHTED CUSHION

BACKGROUND OF THE INVENTION

This invention relates to seating devices, and more particularly to a seating device in which one or more top cushions are movably positioned on a base.

In known furniture of this type, one or more top cushions are typically fastened to the base of the seating device to prevent movement while the seating device is in use. Alternatively, top cushions may simply be placed on a base portion without being fastened thereto. When the top cushions are not fastened to the base they are typically supported by positioning the base against a wall and using the wall for support or by providing the base with top cushion supporting members.

When top cushions are fastened to the base, the resulting configuratiion may not be easily changed to meet the wishes of the user. Similarly, when the top cushion is supported by a wall or a support extending from the base, the seating device may not easily be reconfigured. If the top cushions are merely placed on the base, a highly flexible configuration is obtained, but this arrangement suffers from a substantial drawback in that the top cushions tend to shift position while the seating device is in use.

The general concept of anchoring an object with a weight is well known. For example, a weighted material used to hold down the corners of a beach or picnic blanket is shown in U.S. Pat. No. 3,226,737 to Rote. This reference neither shows nor suggests the concept of movably positioning a top cushion having a weighted lower portion on the base of a seating device.

SUMMARY OF THE INVENTION

An object of the invention is to provide a seating device in which the configuration of top cushions can be easily changed to meet the needs of the user.

A further object of the invention is to provide a seating device having easily movable top cushions which can be maintained in a selected position on a base while the seating device is in use.

Still another object is to provide a seating device which is pleasing in appearance, simple in design, inexpensive to manufacture and easy to install and use.

To these and other ends the present invention contemplates a seating device having a base portion and at least one top portion movably positioned thereon. The top portion has a lower section of relatively heavier material and an upper section of relatively lighter material to enable it to maintain a selected position on the base while the seating device is in use.

In accordance with the invention, the top portion of the seating device comprises a top cushion such as an arm cushion, a back cushion, or a head cushion. The desired weight distribution is achieved by making the top cushion of a relatively low density material such as foam and providing an insert of relatively greater density material in the lower portion of the cushion. This insert may be of a suitable granulate material, such as sand, or of a solid material, such as metal.

Since the top cushion is not permanently fastened to the base, it may be positioned as desired on the base to create a great variety of seating configurations. Furthermore, by providing the top cushion with a weighted lower section, a desired cushion arrangement can be maintained while the seating device is in use. Thus, the invention provides a seating device which exhibits great flexibility and considerable stability without the need for external supports or positioning members for the top cushion.

BRIEF DESCRIPTION OF THE DRAWINGS

FIG. 1 is a side view of a seating device in accordance with the invention;

FIG. 2 is a side view of an alternate embodiment of the top cushion of FIG. 1;

FIG. 3 is a side view of a second alternate embodiment of the top cushion of FIG. 1;

FIG. 4 is a perspective view of a seating device in accordance with the invention;

FIG. 5 is a side view of a seating device in accordance with the invention;

FIG. 6 is a cross-sectional view of a seating device in accordance with the invention;

FIG. 7 is a cross-sectional view of a seating device in accordance with the invention;

FIG. 8 is a perspective view of the insert shown in FIG. 7; and

DETAILED DESCRIPTION

Figure 9:
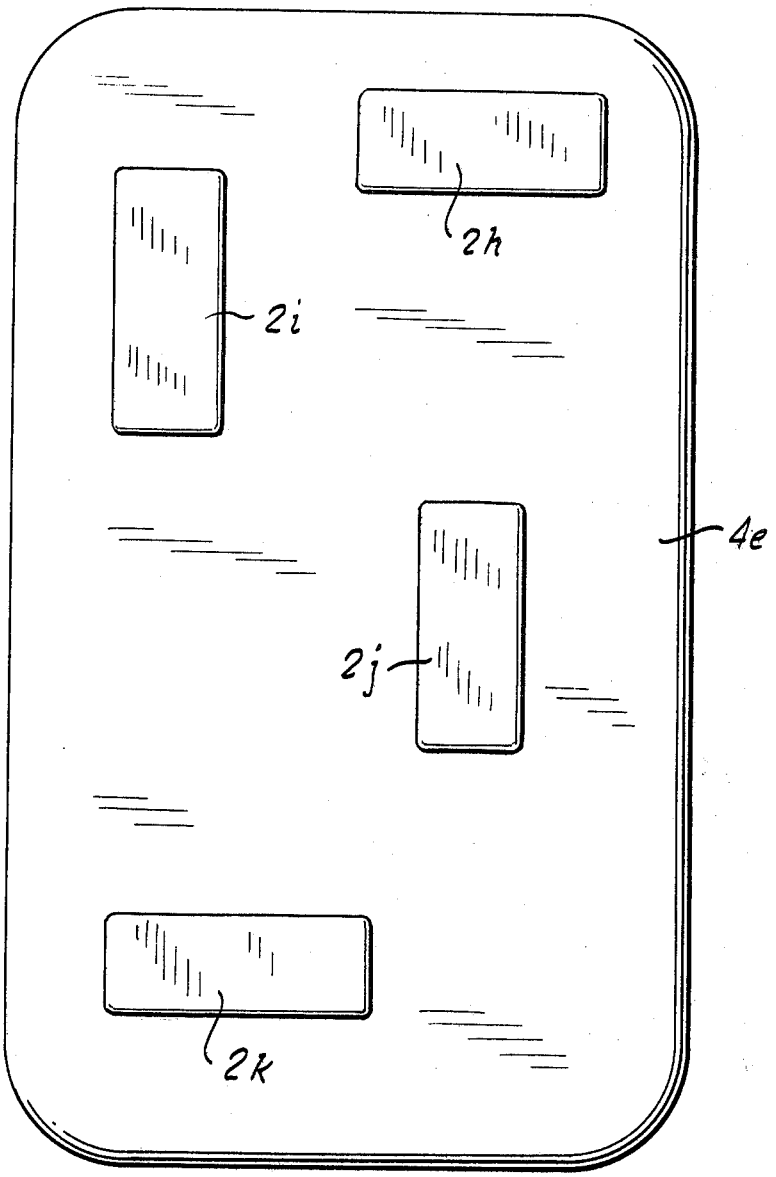
FIG. 9 is a plan view of a seating device in accordance with the invention.

A basic embodiment of the disclosed seating device is shown in FIG. 1. A top portion 2 has a lower section 3 of relatively greater density than its upper section, and is movably positioned on a base 4 to form a seating device 1. Top portion 2 is maintained in the illustrated position while the seating device is in use by its weighted lower secton 3, but can be easily repositioned or removed since it is not connected to base 4.

Two alternate embodiments of top portion 2 are shown in FIG. 2 and FIG. 3. In these figures top portions 2*a* and 2*b* are top cushions of foam, cotton-wool or the like which have inserts 3*a* and 3*b*, respectively, in their lower portions. In each case the insert is of relatively greater density material than 3*d* of the remainder of the top portion. In FIG. 2, insert 3*a* extends across the entire lower part of top cushion 2*a*, while in FIG. 3, insert 3*b* extends over only a portion of the lower section of top cushion 2*b*. For maximum effectiveness, the top cushion shown in FIG. 3 is positioned with the portion containing the insert 3*b* facing the user.

A great variety of seating devices may be assembled by combining the base structure with various top portions to obtain a seating device with back cushions, arm cushions and head cushions. Two illustrative embodiments are shown in FIG. 4 and FIG. 5. In FIG. 4 a rectangular base 4*a* with a flat upper side is provided. Base 4*a* may be of any suitable construction for seating purposes. Top cushions 2*c* and 2*d* are positioned on base 4*a*, with cushion 2*d* serving as a back cushion and cushion 2*c* serving as an arm cushion. A second arm cushion may be provided opposite arm cushion 2*c* to form an armchair. Arm cushion 2*c* is shown with insert 3*c* extending nearly the full width of the cushion, as in FIG. 2, while back cushion 2*d* is illustrated with insert 3d extending over only about half of the cushion width, as shown in FIG. 3. In the latter case the portion of the cushion 2*d* containing the insert 3*d* is positioned to face the user, as shown. Using either of the interchangeable insert configurations shown, the top cushions 2*c* and 2*d* can be easily positioned as desired on the base 4*a* and will remain substantially in place while the seating device is in use due to the stabilizing effect of the inserts.

In FIG. 5, a top cushion 2*e* is placed on an L-shaped base 4*b* to serve as a head cushion. Insert 3*e* may either be of full width, as shown, or of partial width as in FIG. 3. In the latter case the portion of the head cushion 2*e* containing insert 3*e* would be positioned adjacent the user's head for maximum stability.

A cross-section of a seating device embodying the invention is shown in FIG. 6. Rectangular back cushion 2*f* is suitably positioned on the base 4*c*. Back cushion 2*f* has a conventional cover 2*f*'' over a cushioning material 2*f*' of foam, cotton-wool or the like. Insert 3*f* has a covering 3*f*' surrounding a filling 5 of relatively heavy material such as sand, synthetic granulate, or a similar loose, pourable material. Alternatively, insert 3*f* may be a metallic insert, such as an iron bar or pieces of metal. The covering 2*f*'' may be permanently secured over the cushioning material 2*f*' or may be provided with a fastener, such as zipper 6, for removal of the insert.

A VELCRO fastener 10 is shown affixed to the lower rear portion of cushion 2*f* in FIG. 6. This fastener is used when additional holding power is desired, as when the base and top cushions are made of relatively "slippery" fabric, such as velvet or silk. The fastener, which is optional, is preferably positioned at the rear of the top cushion as shown to permit contact with the base to be maintained even if the front portion of the top cushion is lifted slightly when the seating device is in use. Since the fastener is located only on the underside of the top cushion, it is not visible when the top cushion is in place and does not interfere with placement flexibility.

A cross-sectional view of a seating device in accordance with the invention, taken horizontally through insert 3*g*, is shown in FIG. 7. In this figure it can be seen that insert 3*g* has been internally divided into individual chambers 9 by transverse dividers 7 and a longitudinal divider 8. Each of the individual chambers 9 takes a filling 5*a*. In this manner, an even distribution of filling material is established and maintained. FIG. 8 is a perspective view of insert 3*g* of FIG. 7 in which dividers 7 and 8 and chambers 9 are more clearly shown.

In FIG. 9 the invention is shown in a multiple-use application. A large base 4*e* is provided and a plurality of top cushions 2*h*–2*k* are positioned as desired on the base to provide a highly flexible multiple seating arrangement. As in each of the previously-discussed embodiments, a stable yet highly flexible seating arrangement is obtained.

I claim:

1. A top cushion, for use with a seating device having a base portion and movably positionable on said base portion, said top cushion comprising a nonrigid cushion having an upper portion, a middle portion and a lower portion, and an insert in the lower portion thereof, the insert having a relatively and substantially greater density than that of the cushion and sufficient weight to substantially maintain said cushion in a selected position while the seating device is in use.

2. A top cushion as in claim 1, further including a VELCRO fastener affixed to the underside of said top cushion, said fastener contacting the base portion when the top cushion is movably positioned thereon.

3. A top cushion as in claim 1, further comprising:

a pocket in the lower portion of said cushion to receive said insert; and a cover to enclose the cushion and the insert positioned in the cushion pocket.

4. A top cushion as in claim 3, wherein the cover enclosing the cushion and the insert has a fastenable opening in the lower portion thereof to permit the insert to be removably positioned therein.

5. A top cushion as in claim 1, wherein the insert comprises a loose, pourable granulate material and a cover to contain said material.

6. An insert as in claim 5, wherein the insert cover is partitioned into compartments to maintain a desired distribution of granulate material throughout the insert.

7. A top cushion as in claim 2, wherein said top cushion has a forward part and a rearward part, said insert being positioned in the forward part of said lower portion, and said VELCRO fastener being affixed to the rearward part of the underside of said top cushion.

* * * * *